US006742337B1

(12) United States Patent
Hays et al.

(10) Patent No.: US 6,742,337 B1
(45) Date of Patent: Jun. 1, 2004

(54) WASTE HEAT RECOVERY SYSTEM

(75) Inventors: Lance G. Hays, Placentia, CA (US); Duane Bergmann, Big Bear, CA (US)

(73) Assignee: Energent Corporation, Santa Ana, CA (US)

( * ) Notice: Subject to any disclaimer, the term of this patent is extended or adjusted under 35 U.S.C. 154(b) by 0 days.

(21) Appl. No.: 10/277,280

(22) Filed: Oct. 22, 2002

(51) Int. Cl.[7] ..... F01K 23/04
(52) U.S. Cl. ..... 60/655; 60/670; 60/682
(58) Field of Search ..... 60/645, 670, 655, 60/682, 616, 617, 618

(56) References Cited

U.S. PATENT DOCUMENTS 3,802,679 A * 4/1974 Schroeder ..... 266/138
4,300,353 A * 11/1981 Ridgway ..... 60/618
4,627,173 A * 12/1986 O'Hagan et al. ..... 34/369
5,568,834 A * 10/1996 Korenberg ..... 165/104.16
5,881,551 A * 3/1999 Dang ..... 60/39.182
6,526,754 B1 * 3/2003 Bronicki ..... 60/671

* cited by examiner

*Primary Examiner*—Hoang Nguyen
(74) *Attorney, Agent, or Firm*—William W. Haefliger

(57) ABSTRACT

A waste heat recovery system comprising ducting to which hot gas is communicated, means to supply lower temperature diluent gas to the ducting, to mix with the hot gas, and produce a reduced temperature mixed gas stream, a vaporizer in communication with the ducting, to receive the stream and to transfer heat from the stream to a working fluid in the vaporizer to vaporize said fluid, and a blower operating to displace the stream through the vaporizer.

26 Claims, 5 Drawing Sheets

WASTE HEAT RECOVERY SYSTEM

BACKGROUND OF THE INVENTION

Figure 1:
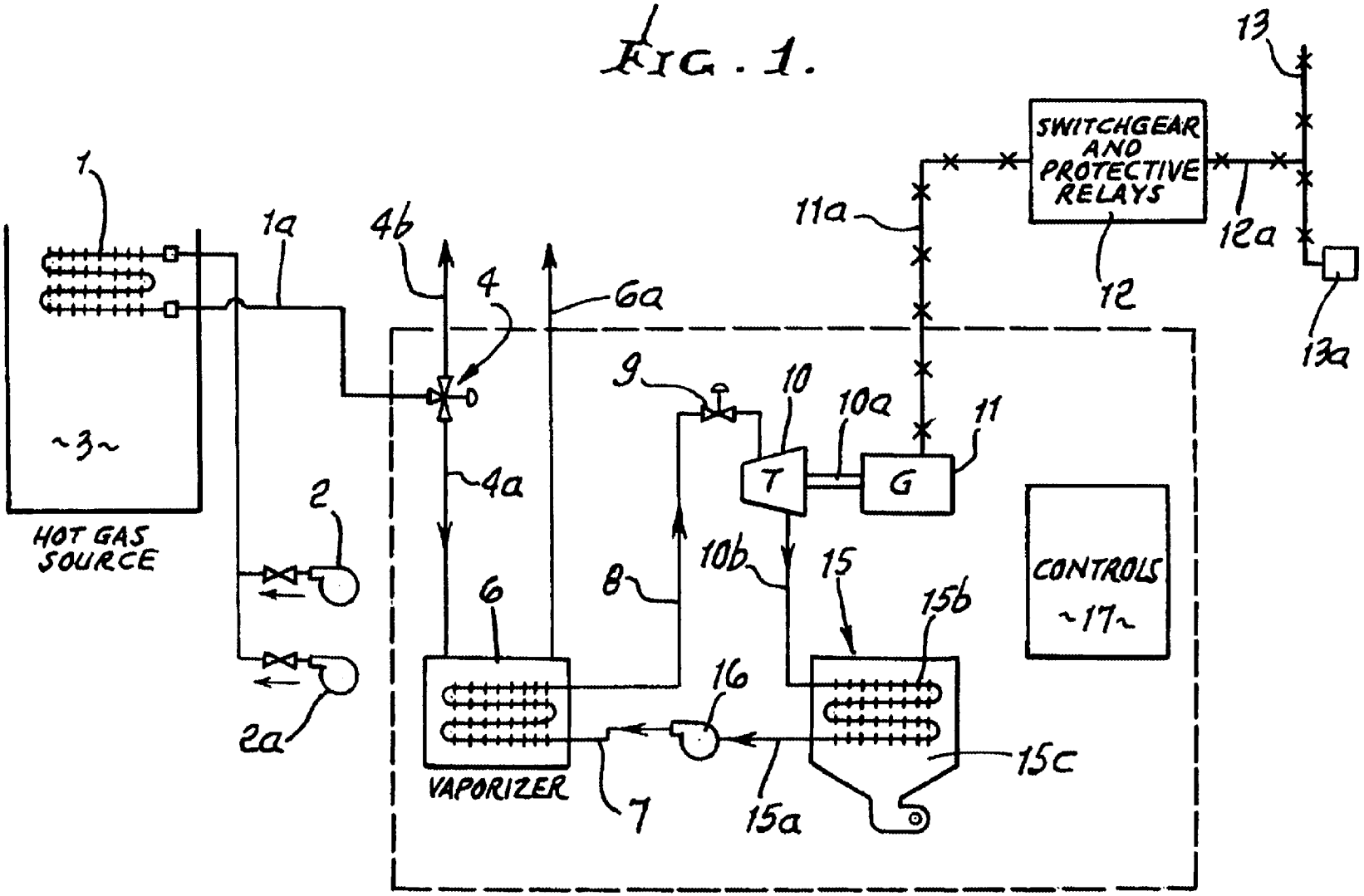

This invention relates generally to a low cost system to utilize waste heat produced in a process.

Recovery of waste heat from combustion sources is an important way to achieve energy conservation that is widely practiced in industry. The waste heat can be used to provide useful heat to a process or to generate power using a heat engine. Some examples are regenerative heating in a glass furnace, generation of hot water for heating from an engine exhaust and generation of steam for power generation from the exhaust of a large gas turbine. However, some sources of waste heat have characteristics that result in excessively high costs to generate useful thermal or power output. These include low temperature, small size, remote location and/or corrosive products. Some examples include landfill gas flares and engine generators which are remote from any useful thermal loads.

Accordingly, there is need for a low cost, efficient method to recovery the waste heat from sources which have not been widely used because of the heretofore uneconomic characteristics.

SUMMARY OF THE INVENTION

It is a major object of the invention to provide apparatus and methods meeting the above need. Basically, the apparatus of the invention includes a waste heat recovery system comprising:

a) ducting to which hot gas is communicated, b) means to supply lower temperature diluent gas to the ducting, to mix with the hot gas, and produce a reduced temperature mixed gas stream, c) a vaporizer in communication with the ducting, to receive the gas stream and to transfer heat from the stream to a working fluid in the vaporizer to vaporize that fluid, d) and a blower operating to displace the gas stream through the vaporizer.

Typically, the blower is of induction type, having an inlet to which the mixed gas stream is supplied after passage through the vaporizer, i.e. the system operates by suction induced stream flow through the vaporizer, such suction also being utilized to induce mixing of the hot gas and cooler gas, in the ducting upstream of the vaporizer. A highly efficient system is thereby achieved.

Another object of the invention is to provide a through opening or openings in a side wall of the hot gas ducting, to pass the lower temperature diluent gas into the ducting in response to suction creation by the blower and communicated to said ducting via the vaporizer. A refractory sleeve or sleeves may be provided in the side wall opening or openings, to block loss of heat to the exterior of the ducting via the side opening or openings.

The system enables use of vaporized working fluid by means to create electric power; and a diverter valve may be advantageously supplied in series with the ducting to i) divert said stream to atmosphere when the the above reference electric power producing means is not operating to produce electric power;

ii) pass said stream to the vaporizer when said means is operating to produce electric power.

These and other objects and advantages of the invention, as well as the details of an illustrative embodiment, will be more fully understood from the following specification an drawings, in which:

DRAWING DESCRIPTION

Figure 3:
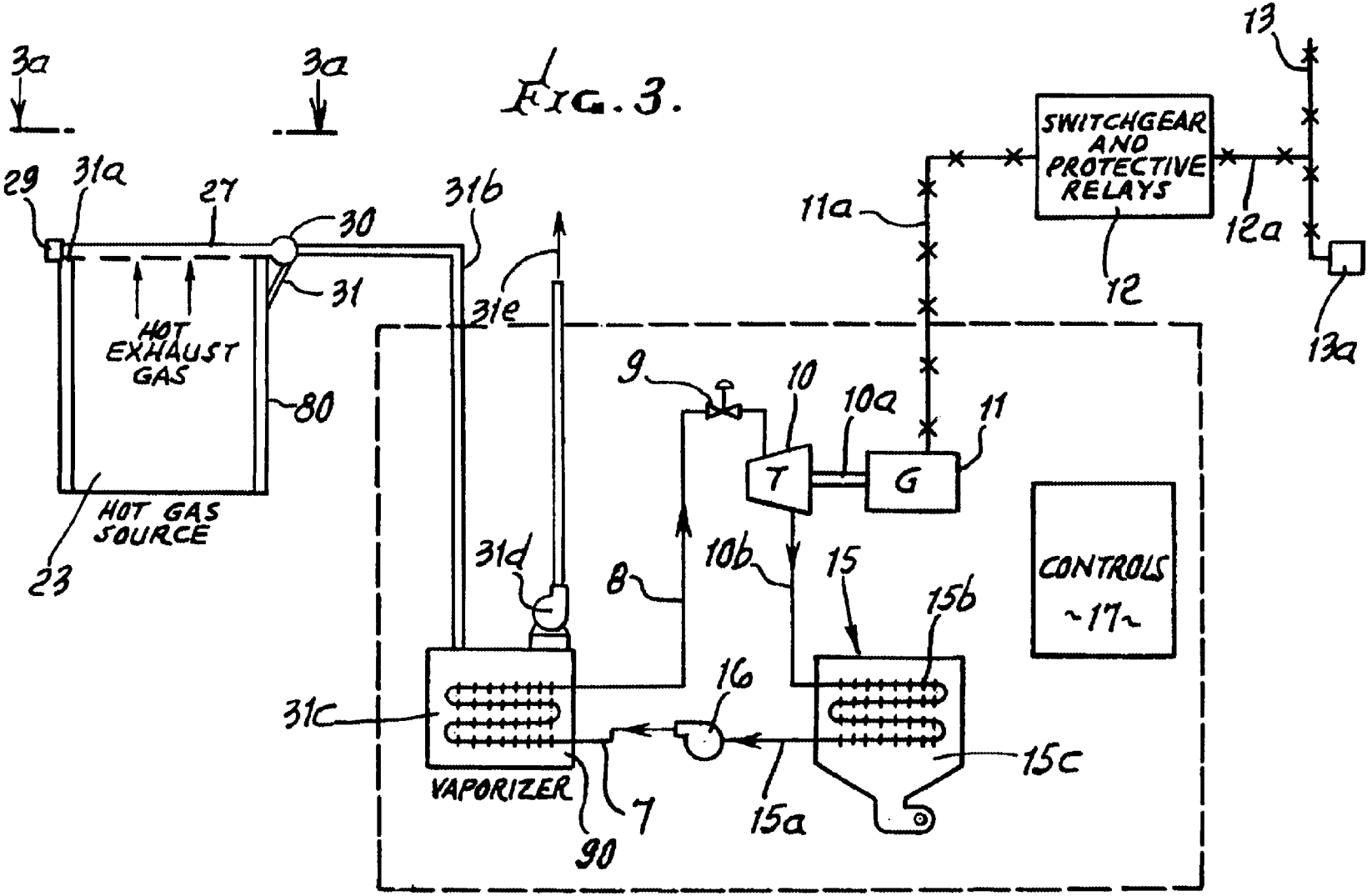
Figure 3A:
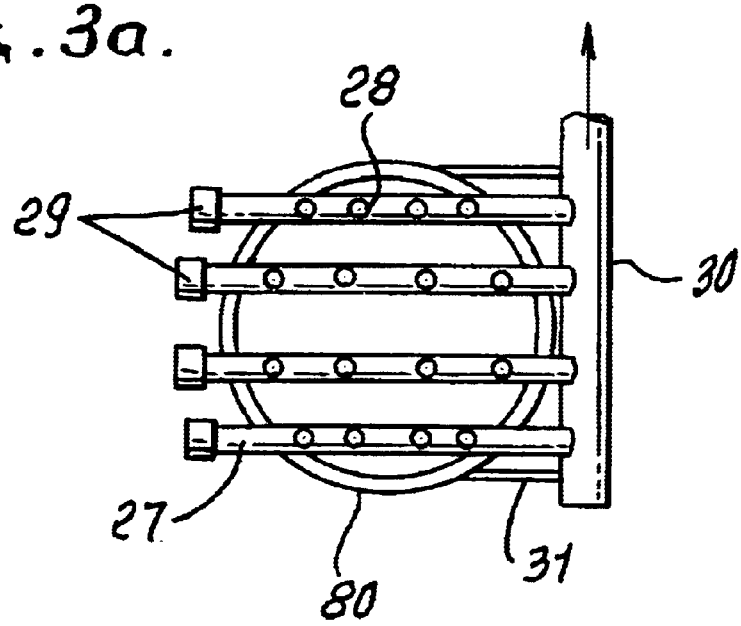
Figure 4A:
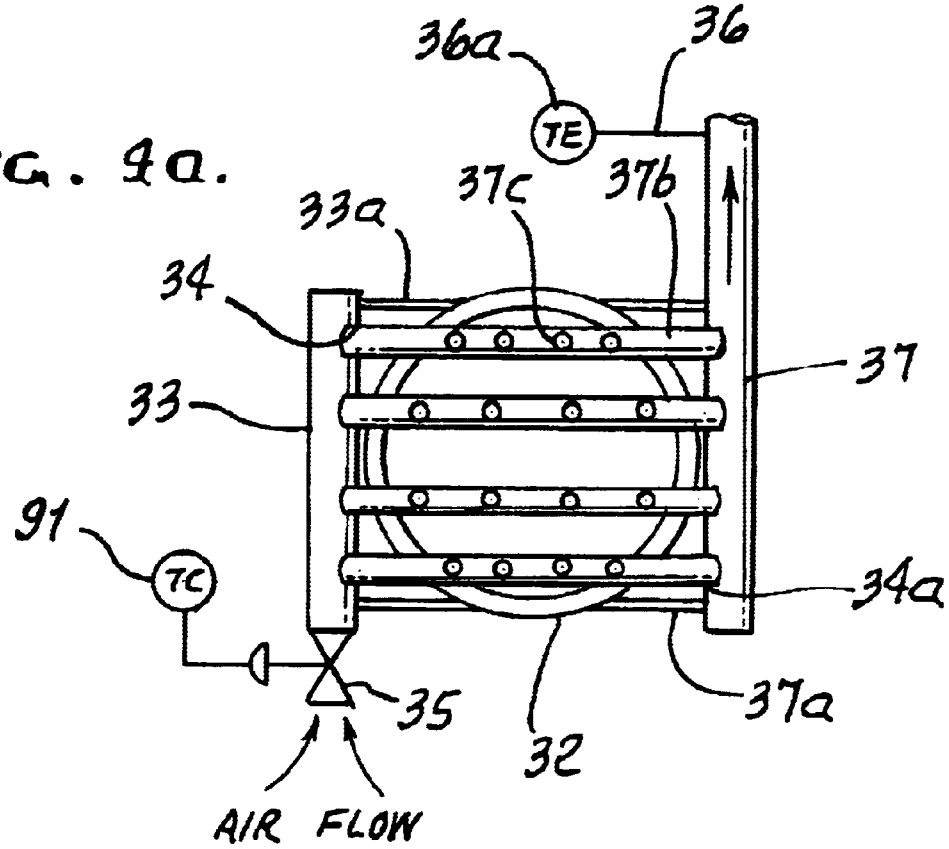
Figure 4:
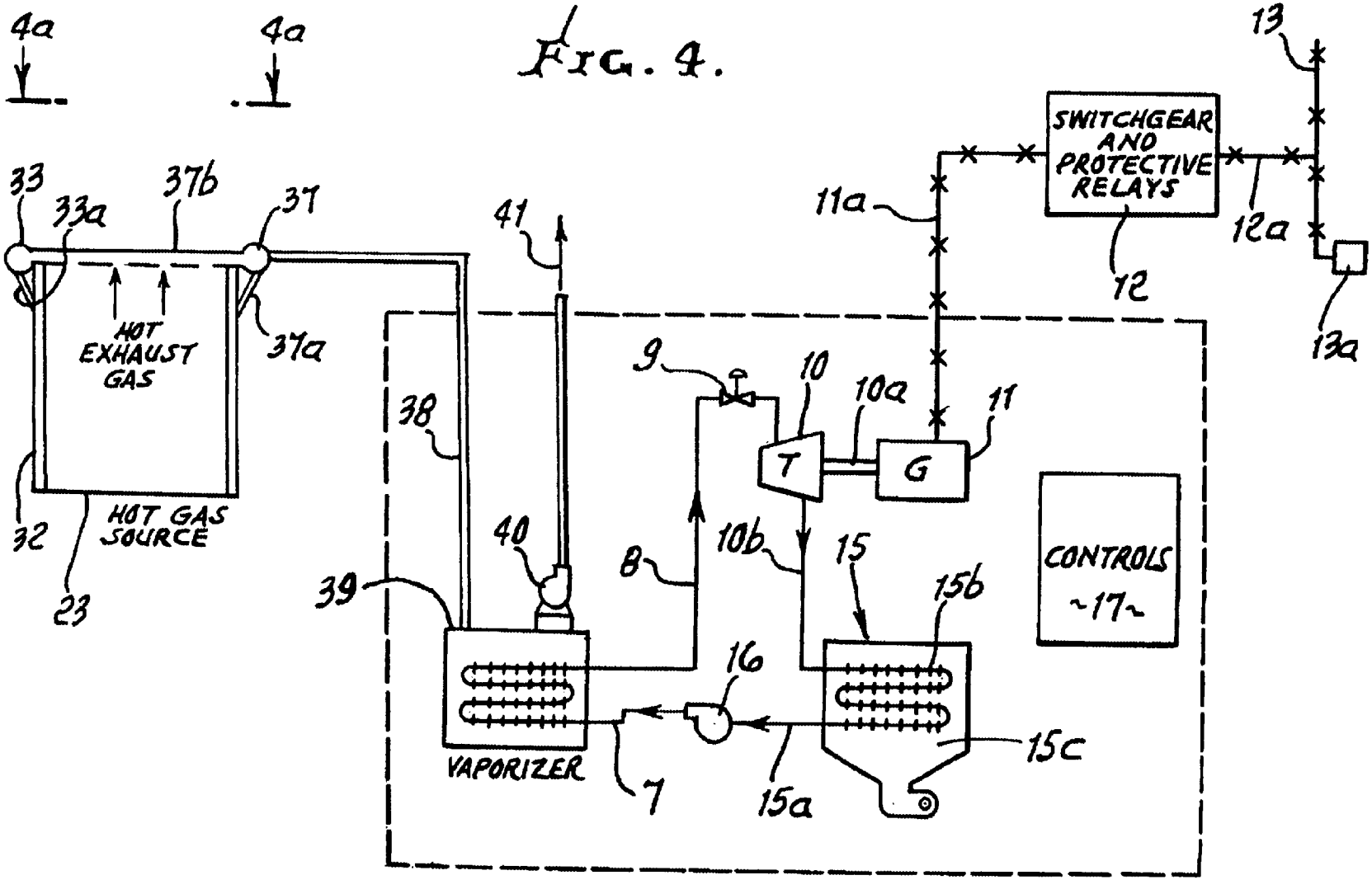

FIGS. 1–3 and 4 are system diagrams;

FIG. 3*a* is a top plan view taken on lines 3*a*–3*a* of FIG. 3;

FIG. 4*a* is a top plan view taken on lines 4*a*–4*a* of FIG. 4.

DETAILED DESCRIPTION

Indirect Waste Heat Recovery System

An indirect waste heat removal system is illustrated in FIG. 1. A heat exchanger 1, with the example having finned tubes, is installed in a hot gas source 3. Air is passed through the heat exchanger by a blower 2. A second blower 2*a*, can be provided so that if the first blower fails, uninterrupted heat removal and heat exchanger cooling can be provided.

The heated air flows through ducting 1*a*, to a diverter valve 4. For times when power is being generated or heat is being used, the diverter valve is positioned so that the hot air is ducted at 4*a* to the thermal load. During times when the power system or thermal load is not operating, the diverter valve ducts at 4*b* the heated air to atmosphere, enabling the heat exchanger structure temperature to remain at its operating value.

For the generation of power, a vaporizer or boiler 6, is provided. The hot air passes through the vaporizer, transferring heat to a working fluid such as water, hydrocarbons or refrigerants, and discharging at 6*a*. The working fluid vaporizes. The vapor is ducted at 8, through a control valve 9, to a turbine 10. The turbine shaft 10*a* drives a generator 11, generating electrical power. The power is conducted through cables 11*a*, to electric switchgear and protective relays 12. The power can be conducted through another cable 12*a*, to the utility grid 13, or directly to an electrical load 13*a*.

The vapor leaving the turbine at 10*b* flows to heat transfer tubing 15*b* in a condenser 15, where heat is transferred to the atmosphere at 15*c*, causing the vapor to condense to liquid. The liquid leaving the condenser at 15*a*, is pressurized by a pump 16, and returned through piping 7, to the vaporizer tubing. Controls for the elements are shown at 17.

Direct Waste heat Recovery System

Figure 2:
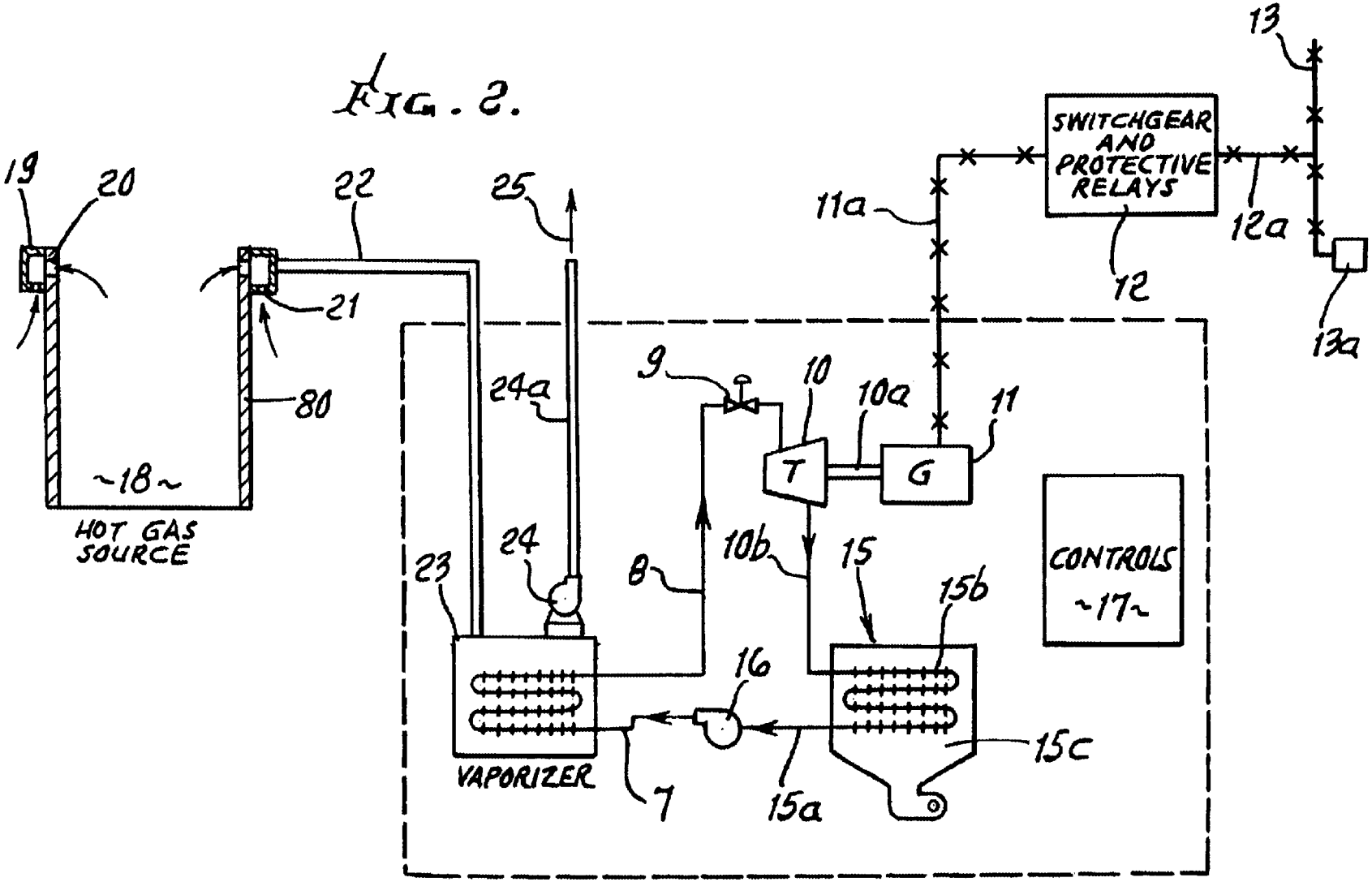

A direct waste heat recovery system is shown in FIG. 2. A source 18 of hot gas is shown with insulated ducting 80. Holes 21 in the ducting are provided with refractory or high temperature metal sleeves 20 to pass the hot gas. A manifold structure 19 is provided into which cooling air is sucked through manifold well holes 21, which mixes with the hot gases to provide an outlet gas stream 22, at the desired temperature. The outlet gas stream is pulled i.e. sucker through the vaporizer 23, or another heat exchanger, by a blower 24. The outlet gas stream leaving the blower at 24*a* has been cooled by the heat exchanged. The cooled outlet gas stream is exhausted at 25, to atmosphere. Other elements the same as those in FIG. 1 bear the same numerals.

Another direct waste heat recovery system is shown in FIG. 3 that uses pipes with holes to suction the hot gas from the hot gas source 23. A metal header pipe 30, is attached 31, to the hot gas duct 80. Pipes 27 with holes 28 facing the hot gas stream are inserted endwise into the metal header pipe 30. Caps 29, are placed over projecting the ends of the pipes.

The fit of the pipes 27 into the metal header pipe, and the fit of the caps 29 on the pipes can be a slip fit, enabling thermal expansion of the pipes to occur and enabling the pipes to be constructed of a material different from the metal header pipe, such as refractory or Inconel alloy. In the case of a vertical hot gas duct, the pipes can seat or rest on top 31*a* of the duct 80, or be inserted through holes in the ducting, once again having a slip fit. The outlet gas stream at 31*b* is pulled through the vaporizer 31*c* or another heat exchanger, by the blower 31*d*, and exhausted to atmosphere at 31*e*. Blower 31*d* has its suction intake side connected to vaporizer chamber 90. Other elements, the same as in FIG. 1, bear the same numerals.

Another direct waste heat recovery system with temperature control at 91 is shown in FIGS. 4 and 4*a*. An inlet metal header 33 is attached 33*a*, to the hot gas duct wall 32. Another metal header pipe 37 is attached 37*a*, to the opposite side of the hot gas duct. Pipes 37*b*, with holes 37*c*, facing the hot gas flow are inserted to project endwise into the metal header pipes to pass hot gas into the pipes. Holes 34 and 34*a* are provided in the headers to provide slip fit with the suction pipes 37*b*, enabling easy assembly, thermal expansion, and the use of dissimilar materials. A control valve 35, is provided on the open end of the metal header pipe 33 to regulate the amount of inlet air pulled into the metal inlet header pipe to mix with the hot exhaust gas received in pipes 37*b*. A temperature sensor and transmitter 36, is installed in the outlet metal header pipe 37 to measure the temperature of the outlet gas, as seen at 36*a*. The output from the temperature sensor and transmitter is utilized to control the position of the control valve 35 such that the temperature of the outlet gas stream 38 is regulated at the desired temperature. The outlet diluent gas stream is pulled through the vaporizer 39, or another heat exchanger, by the blower 40, and exhausted to the atmosphere 41.

Advantages

The advantages of the invention are:

1. An inexpensive method is provided to recover useful heat from a waste heat stream and generate power.
2. The indirect waste heat recovery system enables the use of lower temperature materials in the heat exchanger by providing two full capacity blowers and a diverter valve.
3. The direct heat recovery systems eliminate the use of a conventional heat exchanger which is more costly and heavy.
4. The use of an induction blower with slip fits for the suction pipes or sleeves reduces the fabrication cost and improves reliability. This design also enables the hot gas source to continue operating with no effect on the waste heat recovery system when the waste heat recovery system is not operating by turning off the blower.
5. The use of diluent air to reduce the temperature of the exhaust gas enables the use of less costly materials.
6. For vertical ducts, such as gas combustion (heat source) flares, the use of a structure that is supported by the outside surfaces and rests on top of the duct eliminates penetrations in the ducting.
7. The use of a temperature controlled valve for the air inlet is an inexpensive method to control the temperature of the outlet gas stream.

We claim:

1. A waste heat recovery system comprising:

a) ducting to which hot gas is communicated, b) means to supply lower temperature diluent gas to said ducting, to mix with said hot gas, and produce a reduced temperature mixed gas stream, c) a vaporizer in communication with said ducting, to receive said stream and to transfer heat from said stream to a working fluid in the vaporizer to vaporize said fluid, d) and a blower operating at the exhaust side of the vaporizer and to displace said stream through the vaporizer, by creating a lowered pressure in the ducting acting to suck the diluent gas into the ducting.

2. The system of claim 1 wherein the blower is an induction blower having an inlet to which said stream is supplied after passage through the vaporizer.

3. The system of claim 1 wherein the ducting has a side wall, said means including a through opening or openings in said side wall to pass said diluent gas into the ducting in response to suction creation by the blower and communicated to said ducting via the vaporizer.

4. The system of claim 3 including a refractory sleeve or sleeves within said opening or openings in said side wall.

5. The system of claim 1 including means receiving said vaporized working fluid to create electric power.

6. A waste heat recovery system comprising:

a) ducting to which hot gas is communicated, b) means to supply lower temperature diluent gas to said ducting, to mix with said hot gas, and produce a reduced temperature mixed gas stream, c) a vaporizer in communication with said ducting, to receive said stream and to transfer heat from said stream to a working fluid in the vaporizer to vaporize said fluid, d) and a blower operating to displace said stream through the vaporizer, e) means receiving said vaporized working fluid to create electric power, f) and including a diverter valve in series with said ducting and operable to i) divert said stream to atmosphere when said means is not operating to produce electric power;

ii) pass said stream to the vaporizer when said means is operating to produce electric power.

7. The system of claim 3 wherein said means includes at least one header in communication with said opening or openings, to supply said lower temperature diluent gas to the hot gas in the ducting.

8. A waste heat recovery system comprising:

a) ducting to which hot gas is communicated, b) means to supply lower temperature diluent gas to said ducting, to mix with said hot gas, and produce a reduced temperature mixed gas stream, c) a vaporizer in communication with said ducting, to receive said stream and to transfer heat from said stream to a working fluid in the vaporizer to vaporize said fluid, d) and a blower op e rating to displace said stream through the vaporizer, e) the ducting having a side wall, said means including a through opening or openings in said side wall to pass said diluent gas into the ducting in response to suction creation by the blower and communicated to said ducting via the vaporizer, f) said means including at least one header in communication with said opening or openings, to supply said lower temperature diluent gas to the hot gas in the ducting, q) and including control means responsive to temperature changes of said mixed gas stream to regulate the flow of lower temperature diluent gas to the hot gas in the ducting.

9. The system of claim 1 wherein said hot gas consists of air, and said diluent gas consists of air.

10. The system of claim 1 including a heat exchanger supplying said hot gas to said ducting.

11. The waste heat recovery method that includes the steps a) providing ducting to which hot gas is communicated, b) supplying lower temperature diluent gas to said ducting, to mix with said hot gas, and produce a reduced temperature mixed gas stream, c) providing and operating a vaporizer in communication with said ducting, to receive said stream and to transfer heat from said stream to a working fluid in the vaporizer to vaporize said fluid, d) and providing and operating a blower at the exhaust side of the vaporizer to displace said stream through the vaporizer, by creating a lowered pressure in the ducting, acting to suck the diluent gas into the ducting.

12. The method of claim 1 wherein the ducting has a side wall, in which a through opening or openings is or are formed, and drawing the diluent gas through said opening or openings in response to suction creation by the blower, communicated to the ducting interior via the vaporizer.

13. A waste heat recovery system comprising:

a) ducting to which hot gas is communicated, b) means to supply lower temperature diluent gas to said ducting, to mix with said hot gas, and produce a reduced temperature mixed gas stream, c) a vaporizer in communication with said ducting, to receive said stream and to transfer heat from said stream to a working fluid in the vaporizer to vaporize said fluid, d) and a blower operating to displace said stream through the vaporizer, e) the ducting having a side wall, in which a through opening or openings is or are formed, and drawing the diluent gas through said opening or openings in response to suction creation by the blower, communicated to the ducting interior via the vaporizer, f) and including providing and operating a diverter valve in series with said ducting and operable to i) divert said stream to atmosphere when said means is not operating to produce electric power;

ii) pass said stream to the vaporizer when said means is operating to :produce electric power.

14. A waste heat recovery system comprising:

a) means for removing hot gas from a duct by suction, b) means for reducing the temperature of said hot gas for mixing with a colder gas stream also produced by suction, c) means for transporting the mixed gas stream to a heat exchanger, d) means operating at the exhaust side of the heat exchanger for creating a low pressure to suck the mixed gas stream through the heat exchanger.

15. The combination of claim 14 with holes in the side of the duct through which said hot gas flows.

16. The combination of claim 14 with pipes inserted into said hot gas with holes through which said hot gas flows.

17. The combination of claim 15 with refractory sleeves within said holes.

18. The combination of claim 15 including a means for using said heat exchanger to vaporize liquid and generate electric power.

19. The combination of claim 15 including a means for using said heat exchanger to transfer heat to a useful thermal load.

20. The combination of claim 16 with said pipes inserted into and supported by said mixing means by means of a slip fits in holes.

21. A waste heat recovery system consisting of:

a) means for removing hot gas from a duct by suction, b) means for reducing the temperature of said hot gas for mixing with a colder gas stream also produced by suction, c) means for transporting the mixed gas stream to a heat exchanger, d) means operating at the exhaust side of the heat exchanger for creating a low pressure to suck the mixed gas stream through the heat exchanger, e) there being pipes inserted into said hot gas with holes through which said hot gas flows, f) there being a valve at the entrance to said mixing means, controlled by a temperature sensor and transmitter in said transporting means.

22. The combination of claim 16 with a means for using said heat exchanger to vaporize liquid and generate electric power.

23. The combination of claim 12 with a means for using said heat exchanger to transfer heat to a useful thermal load.

24. A waste heat recovery system consisting of:

a) means to transfer heat from hot gases in a duct to an air stream, b) independent means to subject said air stream to suction, c) means to transport said air stream to a heat exchanger, d) means to divert said air stream from said heat exchanger.

25. The combination of claim 24 including a means to use said heat exchanger to vaporize liquid and generate electric power.

26. The combination of claim 24 including a means to use said heat exchanger to transfer heat to a useful thermal load.

* * * * *